United States Patent [19]

Lipper et al.

[11] Patent Number: 4,936,129

[45] Date of Patent: Jun. 26, 1990

[54] METHOD FOR FORMING A VEHICLE WHEEL

[75] Inventors: Raymond W. Lipper, Newport Beach; Michael J. Beyer, Costa Mesa, both of Calif.

[73] Assignee: Center Line Tool Co., Inc., Santa Fe Springs, Calif.

[21] Appl. No.: 3,727

[22] Filed: Jan. 16, 1987

[51] Int. Cl.[5] ..... B21D 22/16; B21D 53/26; B21H 1/02

[52] U.S. Cl. ..... 72/68; 72/70; 72/83; 29/894.325

[58] Field of Search ..... 72/68, 70, 71, 82, 83; 29/159.01, 159 R, 27 C; 409/165, 166; 83/862, 863, 870, 874

[56] References Cited

U.S. PATENT DOCUMENTS

| | | | |
|---|---|---|---|
| 2075,294 | 3/1937 | Le Jeune | 29/159.01 |
| 3,087,531 | 4/1963 | Pacak | 72/70 |
| 4,388,817 | 6/1983 | Victor | 72/68 |
| 4,523,446 | 6/1985 | Muller | 72/71 |
| 4,532,786 | 8/1985 | Schaible | 72/68 |

FOREIGN PATENT DOCUMENTS

| | | | |
|---|---|---|---|
| 3410308 | 10/1985 | Fed. Rep. of Germany | 29/159.01 |
| 68149 | 5/1980 | Japan | 29/159 R |
| 337 | 1/1983 | Japan | 29/159.01 |
| 82243 | 5/1985 | Japan | 29/159 R |

*Primary Examiner*—Robert L. Spruill
*Attorney, Agent, or Firm*—Spensley Horn Jubas & Lubitz

[57] ABSTRACT

A method of manufacturing vehicle wheels from a disc blank, in which the wheel has rim portions of uniform thickness and different lengths. The wheel is made by spin forging the edge portion of the disc to form an angled portion, splitting the disc into two split portions one of which has the angled portion joined at its end and forming the split portions into a desired rim configuration. A groove may be formed on the periphery of the angled portion to precisely fix the location of the split.

14 Claims, 5 Drawing Sheets

102
100
74

92
93
90
74
d
80
98
96
94

88
t'<t
82
86
84
74
80
84

78
76
76
78
t
74

72
70

METHOD FOR FORMING A VEHICLE WHEEL

BACKGROUND OF THE INVENTION

1. Field of the Invention

The present invention relates to vehicle wheels and more particularly to a method for manufacturing lightweight automotive wheels. Still more particularly, the present invention is directed to a method for manufacturing one-piece vehicle wheels.

2. Description of the Prior Art

A perspective view of a typical automotive wheel 10 is shown in FIG. 1, and FIG. 2 shows a cross-sectional view along a diametral plane A—A of the wheel. The wheel 10 includes a rim 12 and a hub 14. The rim 12 and the hub 14 typically have a contoured cross-sectional shape, as shown in FIG. 2, for structural as well as asthetic purposes. The rim 12 includes two rim portions 16 and 18 which are usually of different length. Flanges 20 are provided at the edges of the rim portions 16 and 18 for retaining an inflatable tire (not shown) to the periphery of the rim 12.

Automotive wheels are most commonly formed of two or three pieces, including a hub section and one or two rim sections. However, a number of attempts have been made to produce one-piece automotive wheels from lightweight materials such as aluminum. U.K. Patent No. 2063722A to Victor discloses a method of manufacturing vehicle wheels starting from a blank in the form of a circular sheet of lightweight metal. Referring to FIGS. 3*a* and 3*b*, the hub 24 of the wheel is formed by shaping the center portion 26 of a blank 22. The rim of the wheel is formed by splitting the peripheral portion 28 of the blank 22 in a radial direction along a plane passing through the blank to form two annular split portions 30 and 32 of equal length and different thickness (FIG. 3*c*), and these portions are subsequently formed by a rolling-pressing operation into rim portions 34 and 36, respectively, of equal thickness and of different lengths (FIG. 3*d*). Specifically, the rim portion 36 which corresponds to the thicker split portion 32 is longer than the rim portion 34 which corresponds to the split 30.

U.S. Pat. No. 4,532,786 to Schaible discloses another method of manufacturing vehicle wheels from a circular metal blank. Referring to FIG. 4, in Schaible, the peripheral portion 38 of a blank 40 is bent at the edge at 42 (FIGS. 4*a* and 4*b*). The peripheral portion 38 is the into two annular split portions 44 and 46 of different thickness, with one of the portion 46 having the bend 42 at its end (FIG. 4*c*). The split portions 44 and 46 are then lengthened by a rolling-pressing operation into rim portions 48 and 50, respectively, of equal thickness but of different lengths (FIG. 4*d*). In this case, the rim portion 50 which corresponds to the split portion 46 is longer than the rim portion 48 which corresponds to the split portion 44 because the split portion 46 has more material, as compared to the split portion 44, due to the bend 42 at its end.

One problem encountered in forming a split rim wheel is that it is difficult to obtain a precise split so that the proper amount of material is available to form each rim portion. Typically, the splitting operation is performed with a cutting roller. It is difficult to accurately control the roller with respect to the blank, especially since the blank may flex during the splitting operation.

It is noted that during the splitting operation, in order to allow the split portions to spread out away from the plane of the peripheral portion, no support can be provided against the surfaces of the peripheral portion to rigidly maintain the peripheral portion when it is split. In addition, it has been found that the interaction between the tool bit and an angled surface (such as in Schaible) can misguide the tool bit and give rise to inconsistent thickness of the split portions.

SUMMARY OF THE INVENTION

The present invention is directed to a method of manufacturing vehicle wheels out of a solid disc blank, in which the rim portions of the wheel have uniform thickness and different lengths. The rim is formed by first spin forging the edge portion of the disc to produce an angled portion with respect to the plane of the disc and at the same time to reduce the thickness of the angled portion. The portion between the angled portion and the hub is then split in a radial direction along a plane of the disc blank into two split portions. One of the split portions has the angled portion at its end and thus is of a greater length than the other split portion. The split portions are then formed into the desired rim configuration by a rolling-pressing operation. To ensure that the splitting operation properly produces split portions of precise desired thickness, a groove may be cut on the angled portion before the splitting operation, at the location where the split is to be initiated. The groove may be cut right after the spin forging operation while the surfaces of the blank are still supported by the spin forging equipment.

BRIEF DESCRIPTION OF THE DRAWINGS

The invention will be described with reference to the accompanying drawings wherein.

DESCRIPTION OF THE PREFERRED EMBODIMENT

The following description is of the best presently contemplated mode of carrying out the invention. This description is made for the purpose of illustrating the general principles of the invention and should not be taken in a limiting sense. The scope of the invention is best determined by reference to the appended claims.

Figure 2:
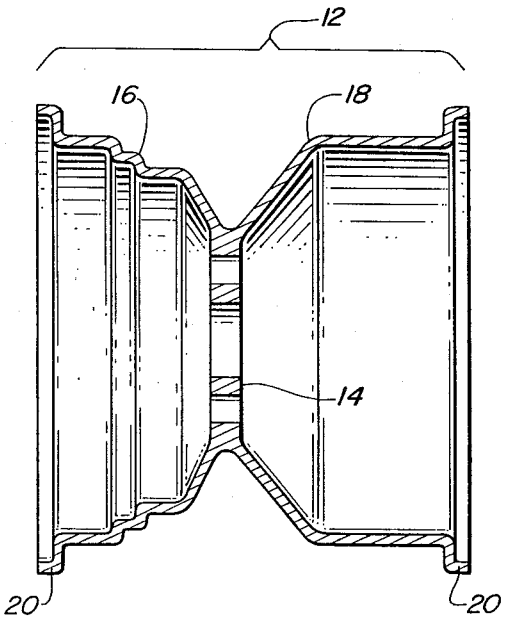
FIG. 2 is a sectional view of the automotive wheel of FIG. 1.
Figure 1:
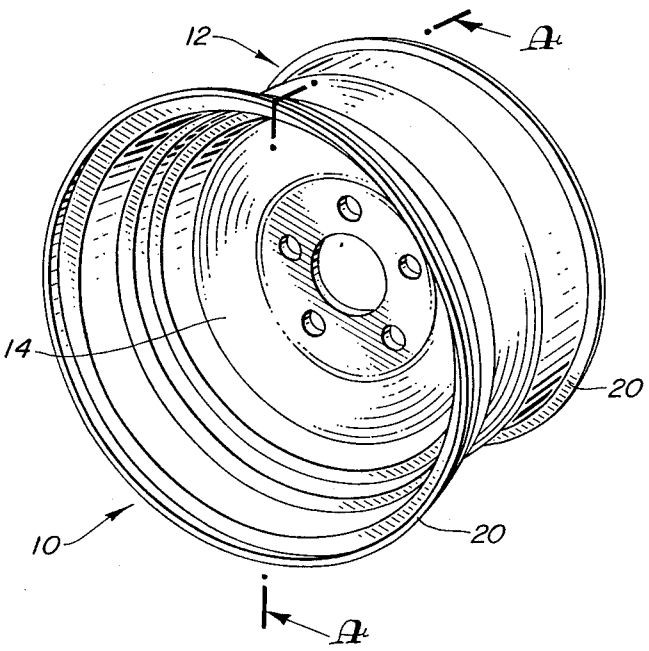
FIG. 1 is a perspective view of an automotive wheel.
Figure 3D:
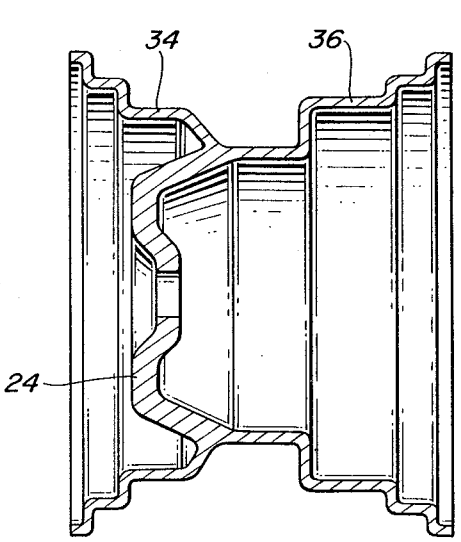
Fig. 3d PRIOR ART
FIGS. 3*a*–3*d* are sectional views illustrating the steps of a prior art method of forming vehicle wheels.
Figure 3C:
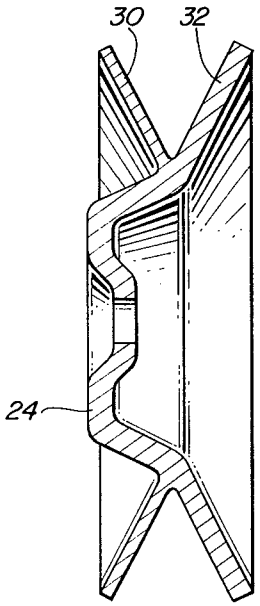
Fig. 3c PRIOR ART
Figure 3B:
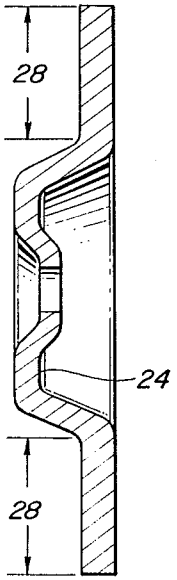
Fig. 3b PRIOR ART
Figure 3A:
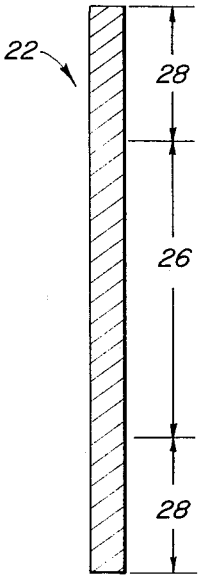
Fig. 3a PRIOR ART
Figure 4D:
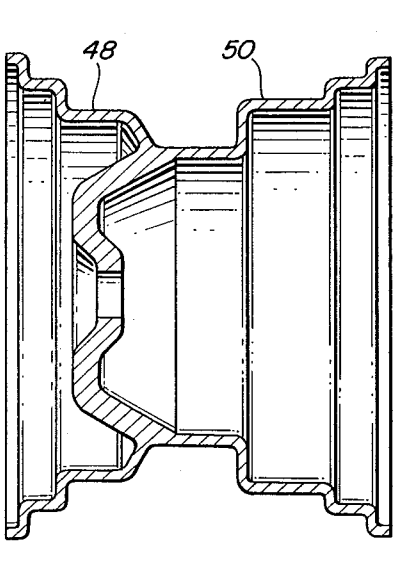
Fig. 4d PRIOR ART
FIGS. 4*a*–4*d* are sectional views illustrating the steps of another prior art method of forming vehicle wheels.
Figure 4C:
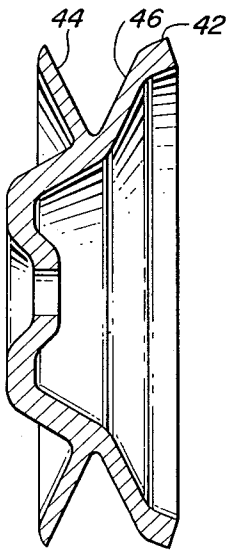
Fig. 4c PRIOR ART
Figure 4B:
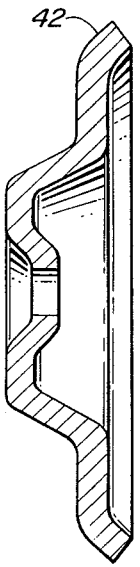
Fig. 4b PRIOR ART
Figure 4A:
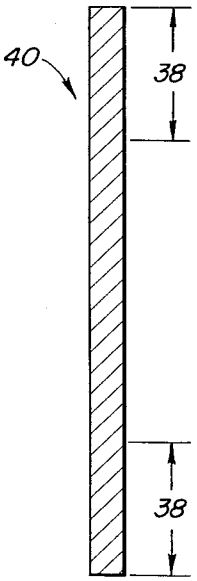
Fig. 4a PRIOR ART
Figures 5A, 5B, 5C, 5D, 5E:
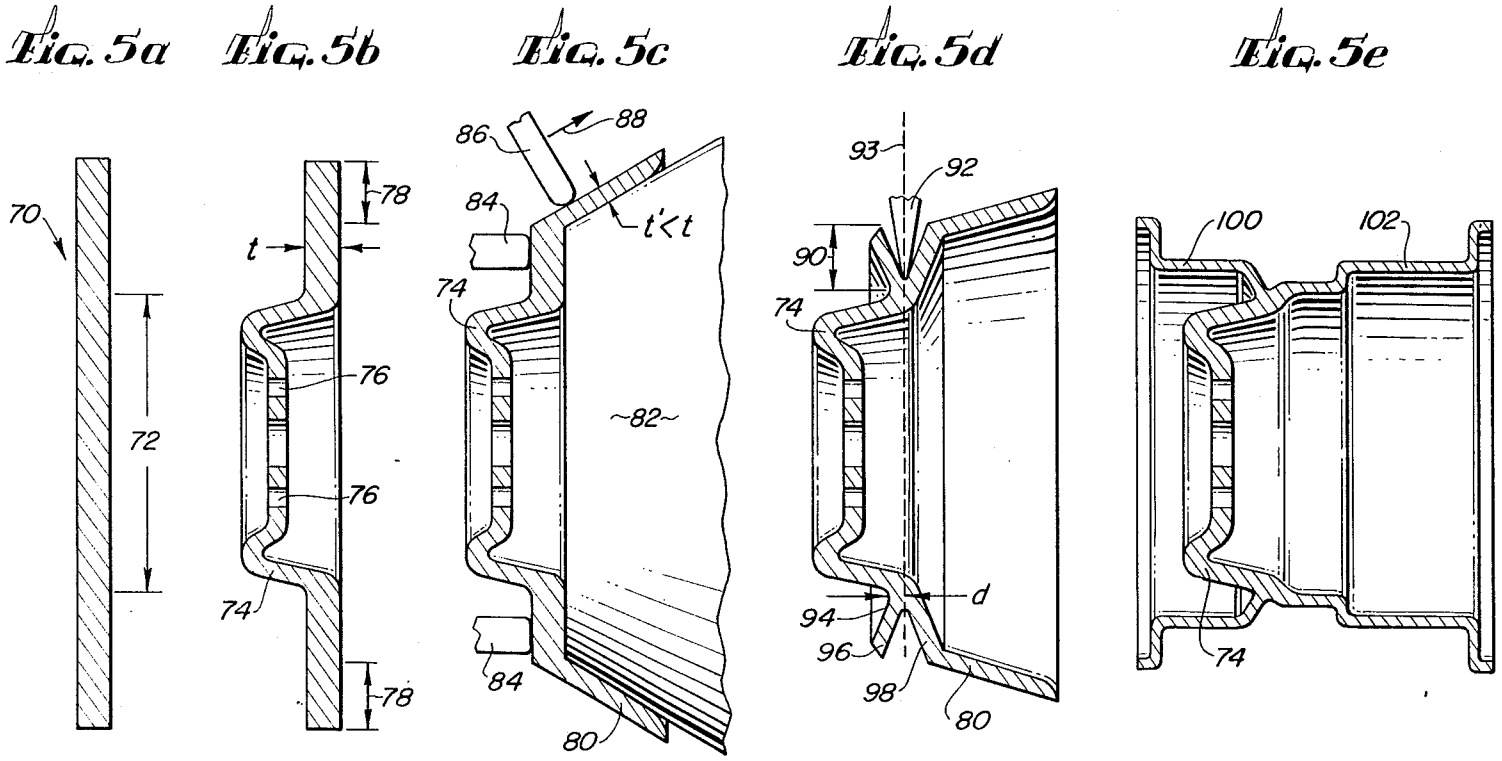
FIGS. 5*a*–5*e* are sectional views illustrating the steps of the method of the present invention.

Referring to FIG. 5, a metal disc typically of aluminum is used as starting blank 70 for forming a vehicle wheel (FIG. 5*a*). As shown in FIG. 5*b*, the center portion 72 of the disc blank 70 may be press forged to form the hub 74 of the wheel. The hub 74 has a desired configuration which provides the wheel with the desired strength as well as asthetic features. Bolt holes 76 are provided at the hub for securing the wheel to an axle of an automobile.

The rim of the wheel is formed by splitting the disc from the edge. However, in order to provide for more material on one side of the disc so that the finished rim portions of the wheel have different lengths, the edge portion 78 of the disc is first angled to one side (FIG. 5c). To do this, the disc blank is placed on a spin forging machine, the details of which are well known in the art, and the edge of the disc is spin forged to form the angled portion 80. During this spin forging operation, the thickness t of the edge portion of the disc blank is reduced to t', i.e. the angled portion 80 is thinner than the original edge portion 78.

As shown in FIG. 5c, the disc blank is forced against a mandrel 82 of the spin forging machine by means of a follower 84. The follower, blank and mandrel are spun about an axis while a roller 86 is moved against the edge portion 78 of the blank in the direction of an arrow 88 to forge the edge portion to the contour of the mandrel 82, which in this case is of a simple angle contour. The roller 86 operates to reposition the metal of the blank in the direction of the arrow 88 so as to provide the thinner cross-section of the angled portion 80. In practice, several forging steps may be required in order to achieve the final angle and thickness. In the preferred embodiment of the invention, the center portion 72 has a thickness of approximately ⅜ inch and the angled portion is spin forged to a thickness of approximately 3/16 inch.

After the spin forging operation described above, the blank is placed on a splitting machine and a middle portion 90, which is the portion of the disc blank bounded by the angled portion 80 and the hub 74, undergoes a splitting operation (FIG. 5d). The splitting operation produces two split portions 96 and 98 to be formed into rim portions 100 and 102, respectively (FIG. 5e), such as by a subsequent spin forging step. The split is made by means of a splitting roller 92 generally shown in FIG. 5d as having a V-shaped apex. The split is centered along dotted line 93, at a predetermined distance d from the side 94 away from the angled portion 80 and in a radial direction through the middle portion 90. The splitting operation must be performed without a follower or mandrel to allow for the V-shaped split to open up. Two split portions 96 and 98 are thus formed wherein one of the split portions 98 has at its end the angled portion 80. The thickness of each split portion depends on the location 93 of the split.

The split portions 96 and 98, including the angled portion 80, are then subjected to spin forging operations to form rim portions 100 and 102 of a desired configuration. The thickness of each rim portion is uniform and typically, the thickness of both portions is approximately the same. Preferably, the thickness of the split portion 98 is chosen to approximately match the thickness of the angled portion 80. This will simplify the subsequent spin forging operation since the forging will be accomplished with respect to a substantially uniform thickness of material.

Thus, it becomes apparent that by first spin-forging an angled portion 80 from the edge portion 78 of the disc blank 70, at least two purposes are served. Firstly, spin-forging redistributes the amount of material between the two surfaces of the disc blank 70 to facilitate the formation of different length rim portions. Secondly, in the same spin forging operation, the extra material which makes up the angled portion, which will be at the end of one of the split portions after the splitting operation, is preformed into an annular portion having a flat surface and a uniform thickness substantially the same as that of the split portion from which it extends, in preparation for the subsequent rim forming operation which is performed after the splitting process. This portion is much easier to work on in the subsequent rim forming operation as compared to a length of material having non-uniform thickness such as obtained with the bending operation of the prior art.

The above described method of forming a wheel can be further facilitated by providing a groove 81 on the periphery of the angled portion 80 prior to the splitting process, at the point where the split is to start. The location of the groove 81 will be determined by the amount of material desired on either side of the split and accordingly, by the thickness of the split portions 96 and 98 and the length of the rim portions 100 and 102. The groove 81 facilitates guiding the splitting roller to the precise split location. In addition, the groove 81 ensures that the split is centered along the desired line 93 through the middle portion 90 so as to produce split portions with uniform thickness. The groove 81 controls possible relative slipping of the cutting roller and the angled portion as the cutting roller makes an initial contact with the slant surface of the angled portion. Said relative sliding could arise especially since the middle portion 90 may flex during the splitting operation since it is of necessity unsupported during the splitting operation. It has been found that without the groove 81, it is very difficult to accurately control the splitting operation, even to the point that in some instances the split portion 96 (FIG. 5d) becomes completely separated from blank.

Figure 6:
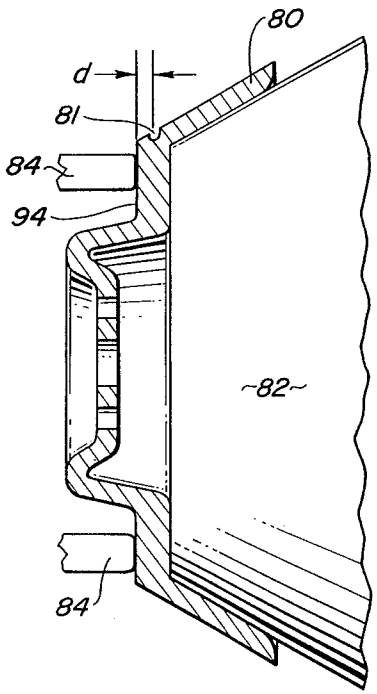
FIG. 6 is a sectional view showing a groove forming step of another embodiment of the present invention.

Referring to FIG. 6, the groove 81 is cut on the angled portion at a predetermined distance d from the surface 94, which corresponds to the thickness of the split portion 96 shown in FIG. 5d. Preferably, the groove 81 has a size of 1/16 inch by 1/16 inch and is slightly rounded to avoid a sharp groove which will misguide the splitting tool. In a preferred embodiment of the present invention, the groove 81 is cut immediately following the spin-forging process while the blank is in place against the mandrel 82 and follower 84 to prevent sideways movement of the disc blank. The disc, blank is therefore rigidly supported while the groove 81 is being cut thereby to fix a precise starting point for the subsequent splitting process. As a result, a tolerance of less than 0.015 inch for the desired split location may be achieved.

The splitting operation is then performed as described previously with reference to FIG. 5 preferably using a splitting roller with an apex having a radius of curvature slightly greater than the radius of curvature of the groove 81. By providing a groove 81 on the angled portion 80 to precisely fix the split location, it is possible to produce split portions 96 and 98 having a thickness variation along the length of each split portion to within a tolerance of less than 1/32 inch, typically 1/1000 inch.

In summary, the present invention provides a method for manufacturing vehicle wheels from a disc blank whereby the rim portions of the wheel has different lengths and are of uniform thickness. The different lengths of the rim portions are provided by spin forging the edge portion of the disc blank to form an angled portion, followed by splitting the disc radially in the plane of the disc and pressing-rolling the split portions to a desired configuration of the rim. A groove may be provided on the periphery of the angled portion to precisely fix the desired location of the split.

It should be noted that the invention is not limited to one-piece wheels. The invention could be applied to wheels with separate hub and rim sections. The groove forming step of the present invention is also not limited in application to spin forged angled portion. This step could be advantageously applied to a method employing a bent edge in order to accurately control the splitting operation. While the invention has been described with respect to the preferred embodiments in accordance therewith, it will be apparent to those skilled in the art that various modifications and improvements may be made without departing from the scope and spirit of the invention.

Accordingly, it is to be understood that the invention is not to be limited by the specific illustrated embodiments, but only by the scope of the appended claims.

I claim:

1. A method of forming a vehicle wheel comprising the steps of:

providing a circular disc of metal material of a predetermined thickness, the disc having a center portion, and middle and edge portions concentric to the center portion;

spin forging the edge portion of the disc to form an annular angled portion at an acute angle to a radial plane of the middle portion, wherein the thickness of the angled portion is less than the thickness of the edge portion and wherein the angled portion and the center portion bound the middle portion of the disc;

forming an annular groove on the periphery of the angled portion where the middle portion is to be split;

subsequently engaging a splitting tool against the annular groove;

rotating the disc and splitting the middle portion of the disc by feeding the splitting tool in a radial direction starting at the annular groove thereby to obtain two annular split portions each having a substantially uniform thickness, wherein the angled portion extends from the end of one of the split portions; and forming the split portions into rim portions of a desired configuration.

2. The of claim 1, wherein the groove forming the step of supporting both sides of the middle while the groove is being formed.

3. The method of claim 2, wherein the groove is slightly rounded.

4. The method of claim 3, wherein the middle portion is split by a roller with an apex having a radius of curvature greater than the radius of curvature of the groove.

5. The method of claim 1, wherein the spin forging step includes the step of supporting the disc firmly using a mandrel and a follower and shaping the angled portion to the shape of the mandrel.

6. The method of claim 5, wherein the groove forming step includes the step of supporting the surfaces of the middle portion with the mandrel and the follower still in place while the groove is being formed.

7. The method of claim 6, wherein the groove is slightly rounded.

8. The method of claim 7, wherein the middle portion is split by a splitting tool bit having an apex having a curvature greater than the curvature of the groove.

9. The method of claim 1 wherein the thickness of the angled portion is substantially equal to that of the split portion from which it extends.

10. The method of claim 9 wherein the split portions have substantially the same thickness.

11. A method of forming a vehicle wheel comprising the steps of:

providing a circular disc of metal material of a predetermined thickness, the disc having a center portion, and middle and edge portions concentric to the center portion;

forming the edge portion into an annular angled portion at an acute angle to a radial plane of the middle portion, wherein the angled portion and the center portion bound the middle portion;

forming an annular groove on the periphery of the angled portion where the middle portion is to be split;

subsequently engaging a splitting tool against the groove;

rotating the disc and splitting the middle portion by feeding the splitting tool in a radial direction starting at the annular groove thereby to obtain two annular split portions, wherein the angled portion extends from the end of one of the split portions; and forming the split portions into rim portions of a desired configuration.

12. The method of claim 11, wherein the groove forming step includes the step of supporting both sides of the middle portion while the groove is being formed.

13. The method of claim 12, wherein the groove is slightly rounded.

14. The method of claim 13, wherein the middle portion is split by a roller with an apex having a radius of curvature greater than the radius of curvature of the groove.

* * * * *